US007367833B2

(12) United States Patent
Matsumoto

(10) Patent No.: US 7,367,833 B2
(45) Date of Patent: May 6, 2008

(54) CONNECTOR WITH ANTI-ROTATION AND ANTI-RETURN MECHANISMS

(75) Inventor: Hiroyuki Matsumoto, Yokohama (JP)

(73) Assignee: J.S.T. Mfg. Co., Ltd., Osaka-shi (JP)

( * ) Notice: Subject to any disclaimer, the term of this patent is extended or adjusted under 35 U.S.C. 154(b) by 0 days.

(21) Appl. No.: 11/642,056

(22) Filed: Dec. 20, 2006

(65) Prior Publication Data

US 2007/0149020 A1 Jun. 28, 2007

(30) Foreign Application Priority Data

Dec. 27, 2005 (JP) ..... 2005-376720

(51) Int. Cl.
*H01R 4/38* (2006.01)
*H01R 13/62* (2006.01)

(52) U.S. Cl. ..... 439/321; 439/315; 439/370

(58) Field of Classification Search ..... 439/321, 439/310, 370, 307, 296, 901, 312–315, 317–319
See application file for complete search history.

(56) References Cited

U.S. PATENT DOCUMENTS 4,030,798 A * 6/1977 Paoli ..... 439/321
4,506,942 A * 3/1985 Flederbach et al. ..... 439/313
5,067,909 A * 11/1991 Behning ..... 439/315
5,145,394 A * 9/1992 Hager ..... 439/321
5,653,605 A * 8/1997 Woehl et al. ..... 439/321
6,234,819 B1 * 5/2001 Oka ..... 439/321

FOREIGN PATENT DOCUMENTS

JP 4-132178 5/1992
JP 2001-57271 2/2001

* cited by examiner

*Primary Examiner*—Hae Moon Hyeon
(74) *Attorney, Agent, or Firm*—Kratz, Quintos & Hanson, LLP

(57) ABSTRACT

A connector is provided having functions for sensing the half-fitted state and improved compactness and workability through a simple construction with few components. The connector includes: a first connector part (2) having a first housing fitted with a contact pin; a second part (21) having a second housing with a contact pin connecting with the aforesaid one; and a rotating ring (15) fitted rotatably to the first or second housing and having locking legs (161) that lock coupling of the two parts. On rotating ring (15), a latching section (181) that inhibits the rotation of the rotating ring and housing where the rotating ring is fitted is provided. Prior to coupling of the two parts, the rotating ring (15) is latched to the housing by the latching sections. During mating-coupling, anti-rotation is terminated by the other part being pushed in, the rotating ring (15) is free to rotate, and coupling of the two parts is locked by the locking legs (161).

8 Claims, 9 Drawing Sheets

(A)

(prior art)

(B)

(prior art)

CONNECTOR WITH ANTI-ROTATION AND ANTI-RETURN MECHANISMS

FIELD OF THE INVENTION

The present invention relates to a connector constituted of a pair of male and female connector parts that are mated and coupled with each other. More particularly it relates to a connector equipped with a sensing function that can sense a half-fitted state when the two parts are coupled.

BACKGROUND OF THE INVENTION

Various connectors have been devised that are equipped with a sensing function that can sense whether the connector, constituted of a pair of parts that are mated and coupled with each other, has been completely mated and coupled, that is, whether it has not been coupled in a half-fitted state (see for example JP-4-132178-A and JP-2001-57271-A).

The connector disclosed in JP-4-132178-A, for example, has male and female connector housings that are mated with each other, being so structured that a follower pin is provided on the inner periphery of a manipulation ring fitted, so as to be freely rotatable, on the outer periphery of the male housing, while on the outer periphery of the other, female housing there is provided a cam groove. The follower pin is engaged into the cam groove so as to mate the male and female housings, and by rotating the manipulation ring in one direction, a lever effect between the cam groove and follower pin is utilized so that the male and female housings can be coupled with a small force.

FIG. 9 is a transverse cross-sectional view of the connector set forth in JP-2001-57271-A, in the locked state.

The connector shown in FIG. 9 is composed of a male and a female connector part that are mated and coupled with each other. It has a structure such that a manipulation ring 31 is fitted, so as to be freely rotatable, to the outer periphery of the female connector part's female housing 30, with a cam mechanism interposed between such and the counterpart male housing; and a spring receiving slot 32 formed on the outer periphery of the female housing 30 holds a coil spring 45, and there is provided on the outer side thereof a manipulation ring 33 provided with a pressing portion 34. When the manipulation ring 31 is rotated in the mating direction, part-way through such rotation the manipulation ring 33 will rotate in an integrated manner, and the coil spring 45 will be compressed by the pressing portion 34. If the rotation is stopped before reaching the locking position where the locking arm 46 latches onto the locking protuberance 47, the manipulation ring 31 will rotate in the reverse direction due to the resilient force of the coil spring 45, and the two housings will be moved apart. Thus, the male and female housings are mated via rotational manipulation of the manipulation ring 31, and if the rotation is stopped before the manipulation ring 31 is locked, then due to the spring force stored in the coil spring 45, the manipulation ring 31 will be returned, while the two housings will be drawn apart. By means of this it can be sensed reliably whether the two housings have been regularly mated.

In the connector disclosed in JP-4-132178-A, the mating condition is sensed after the manipulation ring has been rotated to a particular position and locked during mating-coupling. In other words, a half-fitted state cannot be sensed unless the manipulation ring is turned to a certain position and locked, and this means that there is difficulty with operability. Also, with the connector set forth in JP-2001-57271-A, the mechanism for sensing the mating condition requires a coil spring or similar, which means that the connector's structure is complex. This sensing mechanism too has the operability problem that it cannot sense a half-fitted state until the manipulation ring has been turned to a certain position.

SUMMARY OF THE INVENTION

In consideration of such problems with the related art, the present invention has as its advantage to provide a connector that has a sensing function able to sense the mating condition, and that has improved compactness and workability thanks to having a simple construction with a small number of components.

In order to achieve the aforesaid advantage, according to the present invention a connector includes: a first connector part having a first housing fitted with a contact pin; a second connector part having a second housing fitted with another contact pin that contacts and connects with the contact pin; and a rotating ring that is fitted to the first housing so as to be freely rotatable and that has a locking mechanism that locks the coupling of the first and second connector parts.

The connector has the features that an anti-rotation mechanism that inhibits the rotation of the rotating ring is provided between the rotating ring and the first housing, the rotating ring is latched into the first housing by the anti-rotation mechanism prior to the coupling of the first and second connector parts, and if the first and second connector parts are mated and coupled, the rotation inhibition for the rotating ring is terminated by the second connector part being pushed in, so that the rotating ring is allowed to rotate, and the coupling of the first and second connector parts is locked via the locking mechanism.

According to the present invention the connector above is provided with the further feature that the anti-rotation mechanism is composed of a first latching portion provided on the rotating ring and a second latching portion provided on the first housing, at least one of the first and second latching portions is formed of an elastic material having resilience, and rotation of the rotating ring is prevented by the first and second latching portions mating with each other utilizing the resilience of the elastic section.

According to the present invention the connector set forth above is provided with the further feature that between the rotating ring and a cover member provided so as to cover the rear-end portion of the first housing there is provided an anti-return mechanism that inhibits return rotation of the rotating ring.

According to the present invention the connector is provided with the further feature that the rotating ring is formed as an integrated whole with the cover member.

According to the present invention the connector is provided with the further feature that the anti-return mechanism is provided between the rotating ring and the first housing.

According to the present invention the connector is provided with the further features that the anti-return mechanism is composed of a third latching portion provided on the rotating ring, and a fourth latching portion provided on the cover member, at least one of the third and fourth latching portions is formed of an elastic material having resilience, and the third and fourth latching portions are mated with each other utilizing the resilience of the elastic material.

According to the present invention the connector is provided with the further features that the rotating ring is formed of a round cylindrical body of a particular length, and is so fitted as to cover the outer periphery of the first housing.

According to the present invention the connector is provided with the further features that the first and second housings are each fitted with a grounding member, and if the first and second connector parts are mated and coupled, the grounding members are ground-connected to each other.

According to the present invention the connector is provided with the further feature that the first and second housings are formed as a female and a male housing that are mated and coupled to each other.

Thanks to possessing the foregoing structures, the present invention yields excellent advantages that will now be described. Namely, prior to mating and coupling of the two connector parts, the rotation of the first housing and the rotating ring is inhibited by the anti-rotation mechanism, and during mating and coupling, the anti-rotation mechanism is disengaged as a result of the second connector part being pushed in. More precisely, with the first and second connector parts in the completely mated and coupled state, the rotating ring is able to rotate freely and the two connector parts are locked by the locking mechanism, so that coupling in a half-fitted state is prevented. Thus, a half-fitted state can be sensed via the anti-rotation mechanism provided between the first housing and the rotating ring, and since the mechanism for sensing a half-fitted state can be principally constituted by the rotating ring, the number of components can be reduced and the structure rendered simple, so that greater compactness of the connector can be achieved and the coupling work becomes simpler.

The anti-rotation mechanism is composed of a first latching portion provided on the rotating ring and a second latching portion provided on the housing, at least one of the first and second latching portions is formed of an elastic material having resilience, and the first and second latching portions are engaged with each other by virtue of the resilience of such elastic material(s), so that reliability of engaging is achieved with a simple structure, and a half-fitted state can be sensed with a simple sensing mechanism.

During mating and coupling, the anti-rotation mechanism is disengaged as a result of the other connector part being pushed in, the rotating ring is rotated, and with the coupling of the first and second connector parts locked by the locking mechanism, return of the rotating ring is inhibited by the anti-return mechanism. Thus, turning of the rotating ring is inhibited, and inadvertent decoupling of the two connector parts is prevented.

The rotating ring is provided with a cover member integrated therewith that fastens an electric cable connected to the connector pins, thanks to which the number of components can be reduced.

At least one of the third and fourth latching portions is formed of an elastic material having resilience, thanks to which the rotating ring and the cover member can be coupled easily by utilizing the resilience of the elastic material(s).

The rotating ring is formed of a round cylindrical body of a particular length, and the outer periphery of the first housing is covered by the round cylindrical body, thanks to which, the contact pin and seal member fitted to the first housing are protected by the rotating ring. Also, because the outer periphery of the first housing is protected by the rotating ring, the mating-coupling distance with the second connector part can be rendered long, so that even if the second connector part is inserted into the first connector part in, for example, a diagonal direction, it will be changed to the normal coupling direction, and therefore what is termed "forcing" can be prevented. Further, since the rotating ring is additionally provided with a half-fitted state sensing function and a locking mechanism, the springs or other parts such as are present in the related art are unnecessary, and the number of components is reduced, enabling assembly work and time, etc., to be simplified.

The first and second housings are each fitted with a grounding member, and if the first and second connector parts are mated and coupled, the grounding members are ground-connected to each other, thanks to which, it is a simple matter to form a connector requiring grounding connection.

The first and second housings are formed as a female and a male housing that are mated and coupled to each other, thanks to which, female and male connector parts can be obtained.

DESCRIPTION OF THE PREFERRED EMBODIMENT

A preferred embodiment of the present invention will now be described with reference to the accompanying drawings. It will be appreciated, however, that the embodiment below merely illustrates a connector that embodies the technical concepts of the present invention. The embodiment is not intended to restrict the present invention to this particular connector. Adaptations could yield other embodiments equally valid within the scope of the claims.

First Embodiment

Figure 1:
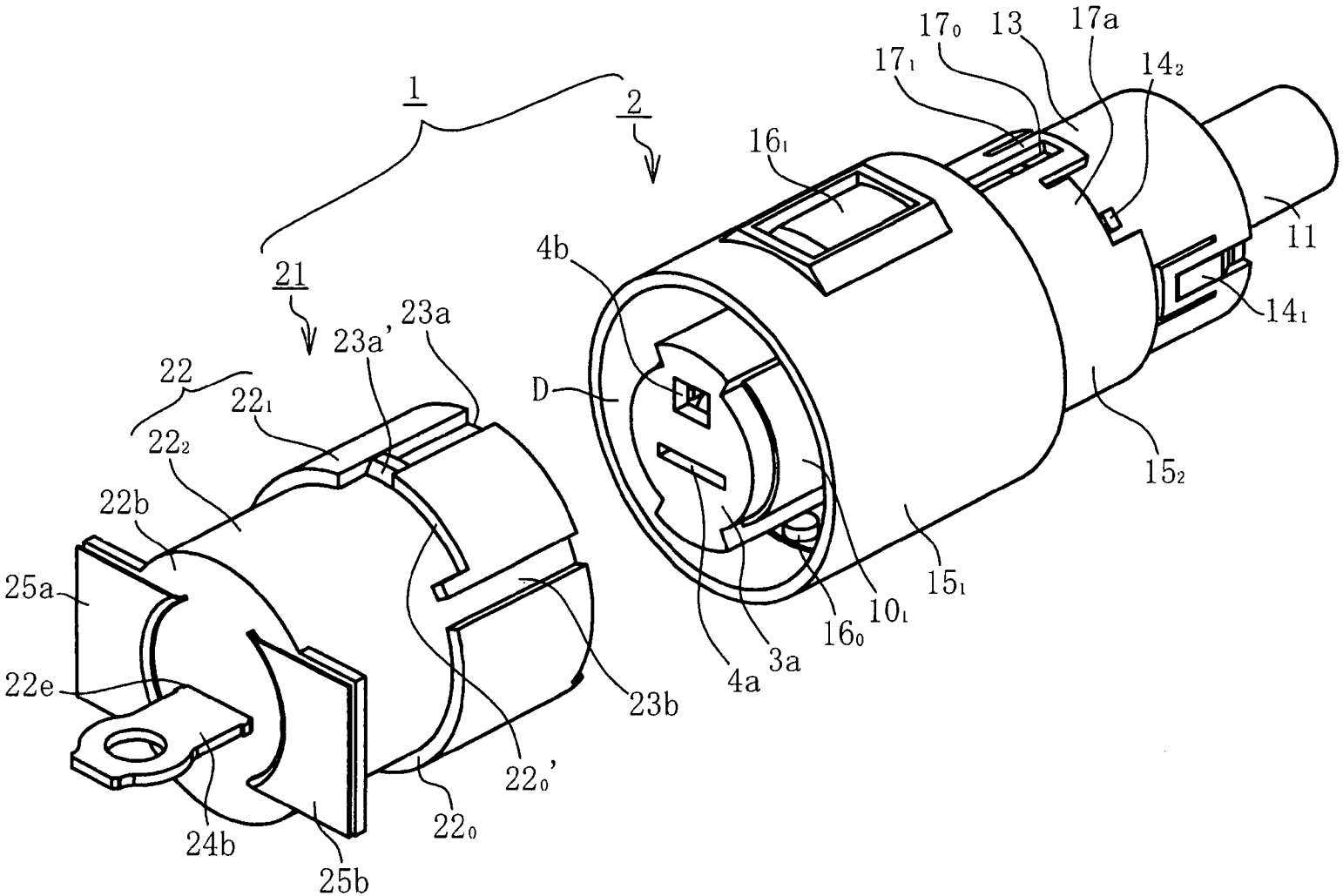
FIG. 1 is a perspective view, prior to coupling, of a connector composed of male and female connector parts in an embodiment of the present invention.
Figure 2:
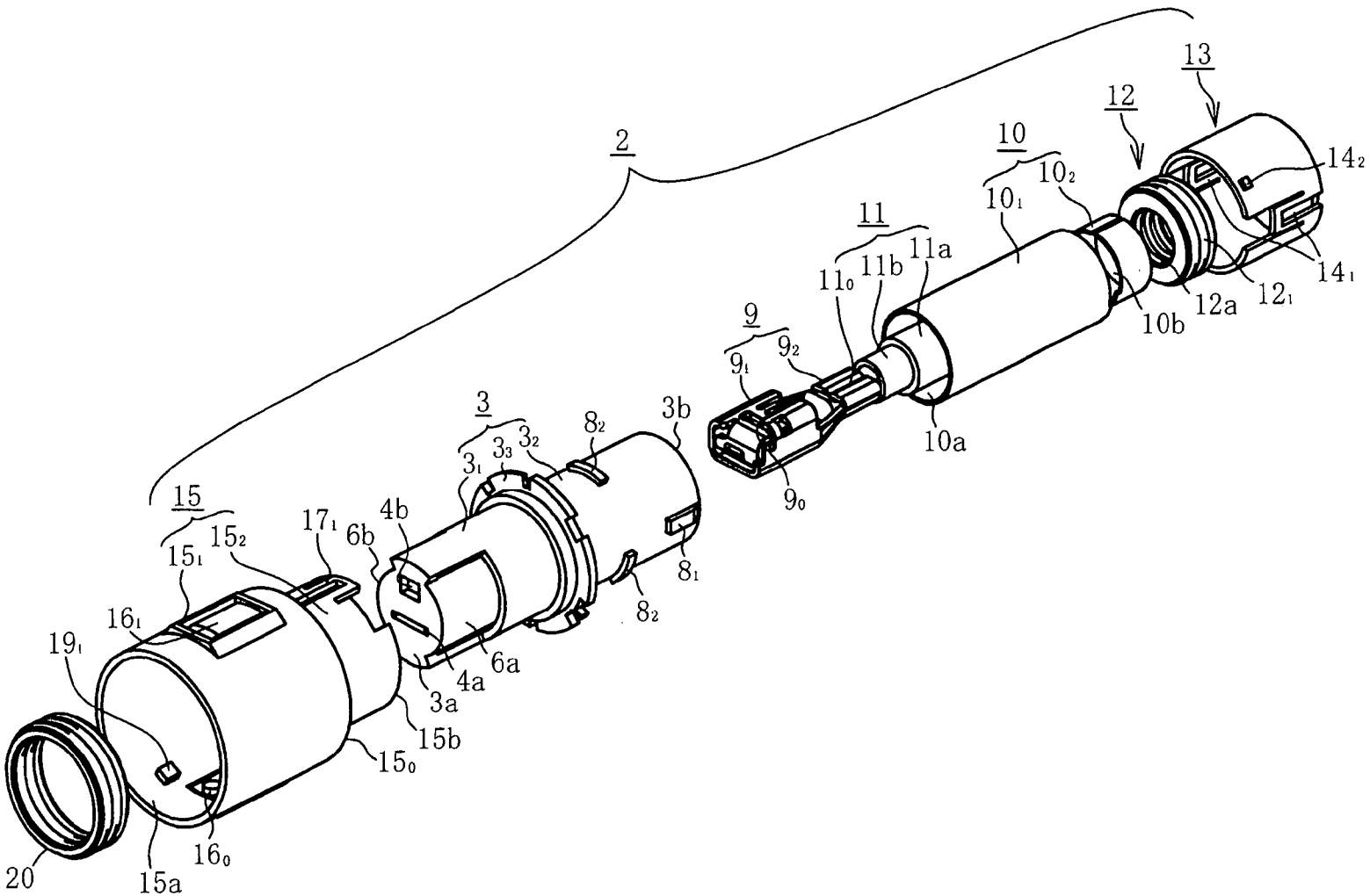
FIG. 2 is an exploded perspective view of the female connector part in FIG. 1.
Figure 3:
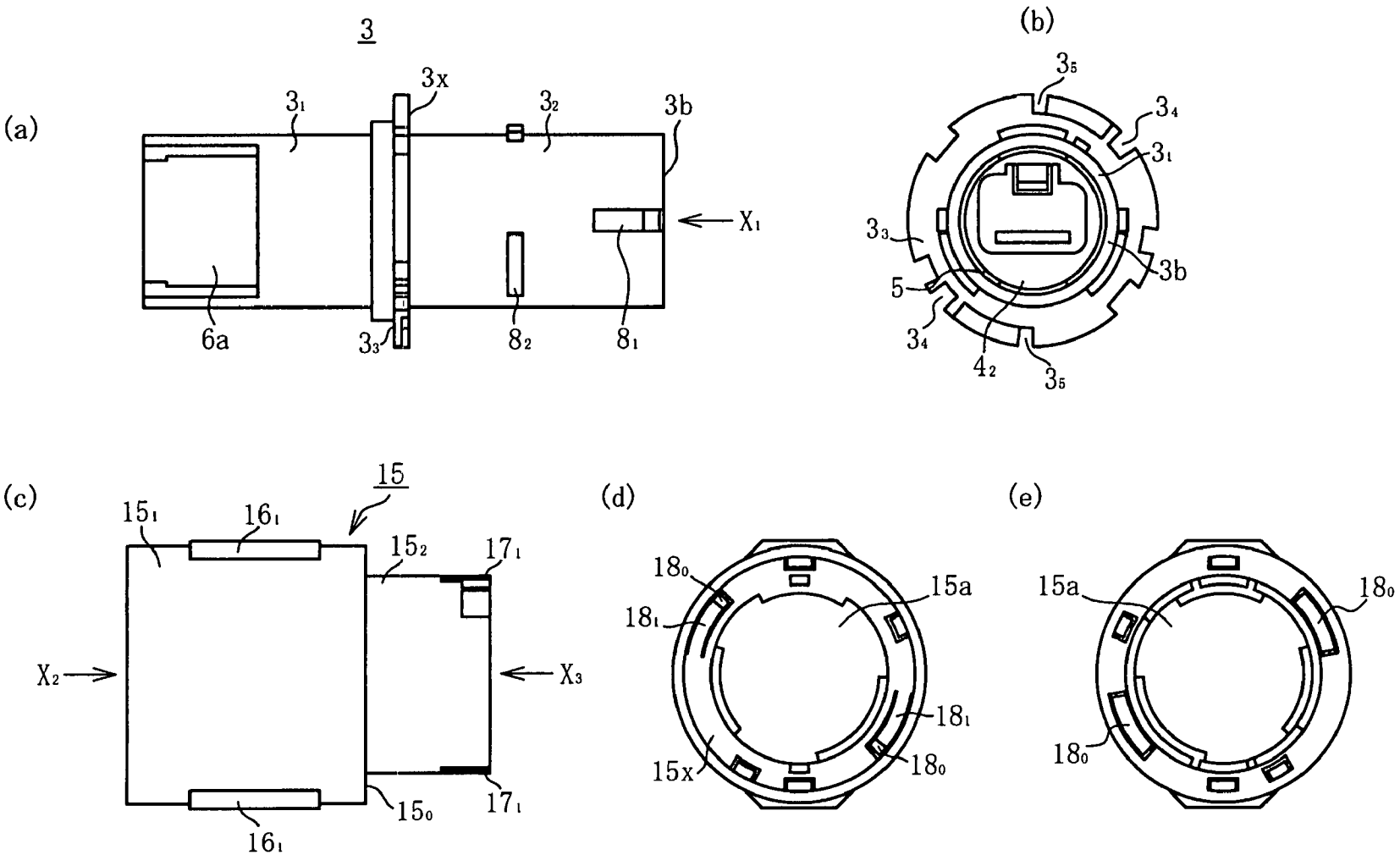
FIGS. 3(*a*)-3(*d*) illustrate the parts in FIG. 2, FIG. 3 (*a*) being a side view of the housing, FIG. 3 (*b*) a rear view looking in direction X1 in FIG. 3 (*a*), FIG. 3 (*c*) a side view of the rotating ring, FIG. 3 (*d*) a front view looking in direction X2 in FIG. 3 (*c*), and FIG. 3 (*e*) a rear view looking in direction X3 in FIG. 3 (*c*).
Figure 4:
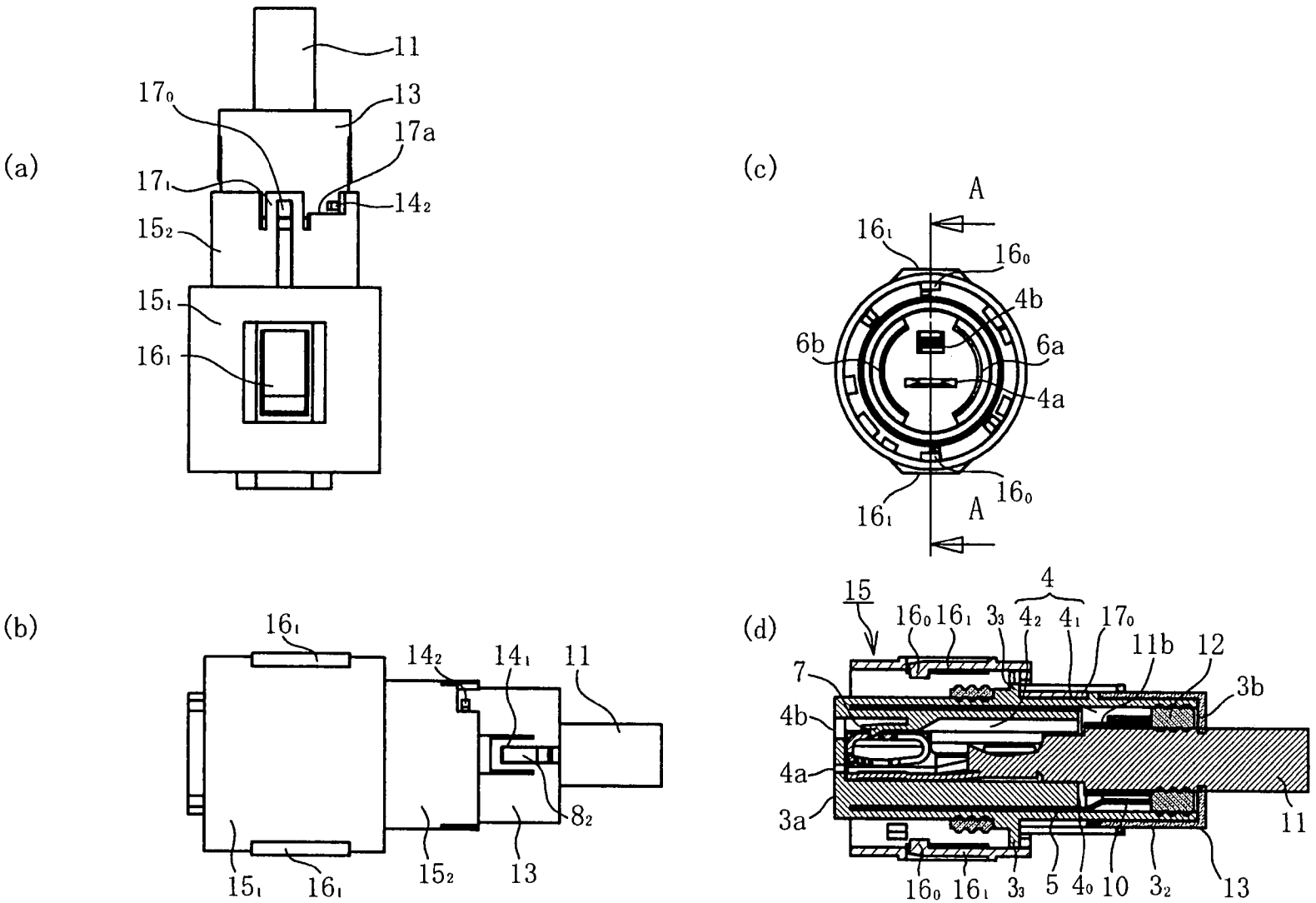
FIGS. 4(*a*)-4(*d*) illustrate the female connector part of FIG. 2 when assembled, FIG. 4 (*a*) being a top view, FIG. 4 (*b*) a side view, FIG. 4 (*c*) a front view, and FIG. 4 (*d*) a cross-sectional view along A-A in FIG. 4 (*c*).
Figure 5:
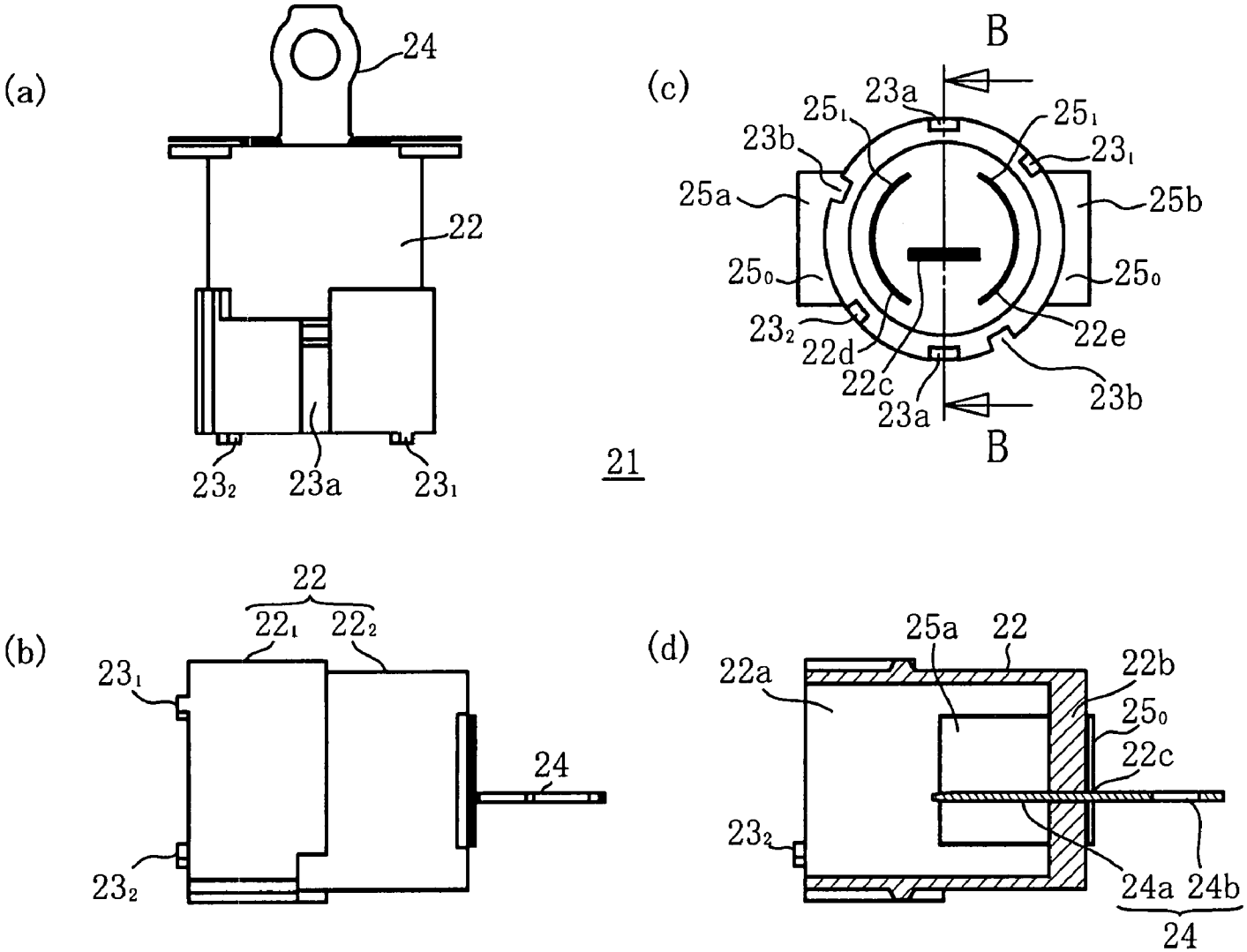
FIGS. 5(*a*)-5(*d*) illustrate the male connector part when assembled, FIG. 5 (*a*) being a top view, FIG. 5 (*b*) a side view, FIG. 5 (*c*) a front view, and FIG. 5 (*d*) a cross-sectional view along B-B in FIG. 5 (*c*).

FIG. 1 is a perspective view, prior to coupling, of a connector composed of male and female connector parts in an embodiment of the present invention. FIG. 2 is an exploded perspective view of the female connector part in FIG. 1. FIG. 3 illustrates various components of the female connector part shown in FIG. 2, FIG. 3 (*a*) being a side view of the female housing, FIG. 3 (*b*) a rear view looking in direction X, in FIG. 3 (*a*), FIG. 3 (*c*) a side view of the rotating ring, FIG. 3 (*d*) a front view looking in direction $X_2$ in FIG. 3 (*c*), and FIG. 3 (*e*) a rear view looking in direction $X_3$ in FIG. 3 (*c*). FIG. 4 illustrates the female connector part of FIG. 2 when assembled, FIG. 4 (*a*) being a top view, FIG. 4 (*b*) a side view, FIG. 4 (*c*) a front view, and FIG. 4 (*d*) a cross-sectional view along A-A in FIG. 4 (*c*). FIG. 5 illustrates the male connector part when assembled, FIG. 5 (*a*) being a top view, FIG. 5 (*b*) a side view, FIG. 5 (*c*) a front view, and FIG. 5 (*d*) a cross-sectional view along B-B in FIG. 5 (*c*). In the following description the rotating ring is provided on the female connector part, but alternatively could be provided on the male connector part.

The connector 1 is constituted of a pair of male and female connector parts 21 and 2 that are mated and coupled with each other, as shown in FIG. 1.

The female connector part 2 is constituted of: a female housing 3 into which a contact pin 9 fits; fixing members 10 to 13 that fix to the female housing 3 the contact pin 9 and the electrical cable 11 connected to the contact pin 9; and a rotating ring 15 that is joined to the female housing 3 so as to be freely rotatable around the outer periphery thereof, as shown in FIGS. 2 to 4.

The female housing 3 is constituted of a round cylindrical body of a particular diameter and a relatively long length, and is formed of synthetic resin. In this female housing 3 constituted of a round cylindrical body is formed an attaching hole 4 into which the contact pin 9, tubular seal material 10 and annular packing 12 are inserted in the order given, through the rear 3*b* toward the front wall 3*a* (see FIG. 4 (*d*)). This attaching hole 4 consists, from the rear 3*b* up to a position situated inward by a certain distance, of a large-diameter first attaching hole $\mathbf{4}_1$ into which the tubular seal material 10 and the annular packing 12 are inserted; and from the aforesaid position toward the front wall surface 3*a*, of a second attaching hole $\mathbf{4}_2$ with a small diameter that matches the outer dimensions of the contact pin 9. At the boundary of the first and second attaching holes $\mathbf{4}_1$ and $\mathbf{4}_2$ there is formed a step difference due to the difference in the diameters of the two attaching holes $\mathbf{4}_1$ and $\mathbf{4}_2$, that is, a step difference wall $\mathbf{4}_0$. Additionally, at the outer periphery of the second attaching hole $\mathbf{4}_2$, lying in the direction from the step difference wall $\mathbf{4}_0$ toward the front wall surface 3*a*, there is formed a gap 5 extending for a particular distance, into which the tubular seal material 10 is inserted. On the inner wall surface above the second attaching hole $\mathbf{4}_2$ there is formed a latching tongue 7, constituted of an elastic material, which latches with the latching portion $\mathbf{9}_0$ of the contact pin 9. Also, the front wall surface 3*a* is a thin enclosed wall, and therein are formed a narrow slot of a size such that the contact pin 24 of the male connector part 21 to be described later can be inserted therethrough, and an insertion hole 4*b* for insertion of a tool that releases the contact pin 9 (see FIG. 4 (*c*)).

At approximately the longitudinal middle portion of the female housing 3 there is formed a round plate shaped flange $\mathbf{3}_3$ that rises orthogonally from the outer periphery wall, the female housing 3 being a round cylindrical body composed of a front portion $\mathbf{3}_1$ and a rear portion $\mathbf{3}_2$ that are divided by the flange $\mathbf{3}_3$ as boundary. This round plate shaped flange $\mathbf{3}_3$ is thin, has a particular height, and has plural cut-out slots $\mathbf{3}_4$, $\mathbf{3}_5$ formed in its outer edge. The rear face $\mathbf{3}_X$ of this round plate shaped flange $\mathbf{3}_3$ will contact against the inner surface of the step difference wall $\mathbf{15}_0$ of the rotating ring 15 to be described later. Also, the rotating ring 15's latching tabs $\mathbf{18}_0$, $\mathbf{18}_0$ to be described later latch into the cut-out slots $\mathbf{3}_4$, $\mathbf{3}_5$.

On the two longitudinal sides of the front portion $\mathbf{3}_1$ of the female housing 3 there is formed, almost left-right symmetrically, a pair of indented portions 6*a* and 6*b*. These indented portions 6*a* and 6*b* are formed as far as the approximate middle portion of the front portion $\mathbf{3}_1$, and communicate with the gap 5 inside the female housing 3.

The fact that the indented portions 6*a* and 6*b* communicate with the gap 5 means that when the female connector part 2 is assembled, part of the tubular seal material 10 is exposed. And being provided on both of the sides of the front portion $\mathbf{3}_1$, the indented portions 6*a* and 6*b* also perform a positioning function during coupling with the male connector part 21.

On the outer surface of the rear portion $\mathbf{3}_2$ there are formed first and second latching protrusions of two types, $\mathbf{8}_1$ and $\mathbf{8}_2$. The first latching protrusion $\mathbf{8}_1$ engages with the latching portions $\mathbf{14}_1$ of the cover member 13. The second latching protrusions $\mathbf{8}_2$ latch to small protuberances (omitted from the drawings) provided in the inner wall of the rotating ring 15, when the rotating ring 15 is inserted into the female housing 3. Thus, the rotating ring 15 is fixed by the flange $\mathbf{3}_3$ and the second latching protrusions $\mathbf{8}_2$.

Also, annular packing 20 is fitted to the front portion $\mathbf{3}_1$ of the female housing 3. This annular packing 20 is constituted of short length annular bodies of particular thicknesses, with a through-insertion hole provided in the center portion, and is formed of elastic members such as rubber members. When the male and female connector parts 21 and 2 are coupled, this annular packing 20 is pressed inside the opening 22*a* of the male housing 22 to be described later. The outer periphery of the annular packing 20 will preferably be formed into a concavo-convex pattern. By providing concavo-convex protuberances in this way, the entry of water, etc., can be impeded.

The contact pin 9 has, as shown in FIG. 2, a contacting portion 9, into which a flat plate-form contact 24 is inserted, and a cable connecting portion $\mathbf{9}_2$ to which the cores $\mathbf{11}_0$ of the electric cable are clamp-connected, and is formed of a metal material with good conductivity. Also, a latching portion $\mathbf{9}_0$ is formed on the top surface of the contacting portion $\mathbf{9}_1$.

The fixing members 10 to 13 are composed, as shown in FIG. 2, of the tubular seal material 10, the annular packing 12 and the cover member 13.

The tubular seal material 10: is made up of a cylindrical portion $\mathbf{10}_1$ that is inserted into the gap 5, and a clamping portion $\mathbf{10}_2$ that is linked to the cylindrical portion and is clamp-connected to the electric cable; has a diameter roughly the same as the circularly-formed gap 5, and a length almost the same as the length of the second attaching hole $\mathbf{4}_2$; and is formed of a metal material with good conductivity. The clamping portion $\mathbf{10}_2$ is formed from split ring pieces so as to be able to shrink in diameter when clamp-connected to the shielding 11*b* of the electric cable. Reference numeral 11*a* indicates the electric cable's insulating sheath member.

The annular packing 12 is constituted of short length annular bodies of particular thicknesses, with an electric cable through-insertion hole 12*a* provided in the center portion, and is formed from elastic members such as rubber members. When the electric cable 11 is press-fitted into the through-insertion hole 12*a*, the annular packing 12 is pressed into the first attaching hole $\mathbf{4}_1$ of the female housing 3. The outer periphery of the annular packing 12 will preferably be formed into a concavo-convex pattern. By providing concavo-convex protuberances in this way, the fixing of the electric cable can be rendered firm, and also the entry of water, etc., can be impeded.

The cover member 13 is constituted of a round cylindrical body having a diameter size and a particular length such that it can be inserted into the rear portion $3_2$ of the female housing 3, and is formed of synthetic resin. The cover member 13 is inserted so as to cover the outer periphery of the end part of the rear portion $3_2$ of the female housing 3, and in addition has plural—for example two—latching portions $14_1$, $14_1$ and small protuberances $14_2$, $14_2$ formed on its longitudinal outer surface. These latching portions $14_1$, $14_1$ and small protuberances $14_2$, $14_2$ are each provided in opposite positions on the outer surface; in FIG. 2, one latching portion $14_1$ and one small protuberance $14_2$ are hidden.

The rotating ring 15 is, as shown in FIG. 2 and FIGS. 3 (*c*) to (e), composed of a large-diameter cylindrical portion $15_1$ whose diameter is larger than the outer diameter of the female housing 3, and a small-diameter cylindrical portion $15_2$ whose diameter is smaller than the large-diameter cylindrical portion, and is formed of synthetic resin, the cylindrical portions $15_1$ and $15_2$ being joined into an integrated whole. At the join between the two cylindrical portions $15_1$ and $15_2$ a step difference is formed, constituting a step difference wall $15_0$. The large-diameter cylindrical portion $15_1$ serves as a hood or cover body of a length such as to cover the front portion $3_1$ of the female housing 3. The diameter of the large-diameter cylindrical portion $15_1$ is larger than the diameter of the female housing 3, and when fitted to the female housing 3, a gap D (see FIG. 1) into which the male housing 22 is inserted is formed between the outer periphery surface of the female housing 3 and the inner surface of the large-diameter cylindrical portion $15_1$. Parts of the outer surface of the large-diameter cylindrical portion $15_1$ are cut out, and there a pair of elongated locking legs $16_1$, $16_1$ of a particular width and length is formed. These locking legs $16_1$, $16_1$ are constituted of elastic materials of which the base is fixed to the outer surface and the other edges are free extremities, and have a locking bar $16_0$ formed at the tip (see FIG. 4 (*d*)). These locking legs $16_1$, $16_1$ are for preventing the two connector parts 21 and 2 from being pulled apart when mated and coupled. Also, plural—for example two—small protuberances $19_1$, $19_1$ are formed on the inner surface of the large-diameter cylindrical portion $15_1$. In FIG. 2, one of the two small protuberances $19_1$, $19_1$ is illustrated, while the other is hidden. These small protuberances $19_1$, $19_1$ engage with the flat-bottomed thin slots 23*b*, 23*b* in the male housing 22, and serve a retaining function.

The small-diameter cylindrical portion $15_2$ has an inner diameter such as to be inserted into the rear portion $3_2$ of the female housing 3, and has a pair of latching portions $17_1$, $17_1$ possessing resilience formed at its end portion in opposite positions. Formed by cutting out two thin slots to extend longitudinally at the end portion, these latching portions $17_1$, $17_1$ are elongated pieces of a particular width, and in the center portion of each there are formed thin slots $17_0$, $17_0$ which engage with the small protuberances $14_2$, $14_2$ provided in the cover member 13 and are aligned with the longitudinal direction of the small-diameter cylindrical portion $15_2$. Resilience is imparted to the latching portions $17_1$, $17_1$ through the provision of the thin slots at both their sides. The engaging of the small protuberances $14_2$ and the above-mentioned thin slots $17_0$ serves to prevent return of the rotating ring 15 after rotating. Here, it is the latching portions $17_1$, $17_1$ that are elastic materials, but alternatively the latching portions of the small protuberances on the cover member 13 could be formed as elastic materials. Further, on one side of each of the latching portions $17_1$, $17_1$, part of the end portion of the small-diameter cylindrical part $15_2$ is also cut away, thus forming indented portions 17*a*, 17*a* (see FIGS. 1 and 7).

Also, as shown in FIG. 3 (*d*), on the inner surface $15_X$ of the step difference wall $15_0$ there is formed a pair of latching sections $18_1$ and $18_1$, having respectively latching tabs $18_0$, $18_0$ which latches into the cut-out slots $3_4$, $3_4$ in the flange $3_3$. These latching sections $18_1$ and $18_1$, are formed of strip-shaped elastic materials of a particular length, whose bases are fixed to the step difference wall $15_0$ and whose outer ends are free extremities. With the connector in the assembled state, the latching sections $18_1$ and $18_1$, contact against the rear face $3_X$ of the flange $3_3$ and the latching tabs $18_0$, $18_0$ engage into the cut-out slots $3_4$, $3_4$, with the result that rotation of the rotating ring 15 is inhibited. In other words the anti-rotation mechanism is constituted by these latching tabs $18_0$, $18_0$ and the cut-out slots $3_4$, $3_4$.

Next, the assembly of the female connector part using the parts structured in the foregoing manner will be described with reference to FIGS. 2 to 4 and FIG. 6.

Figure 6:
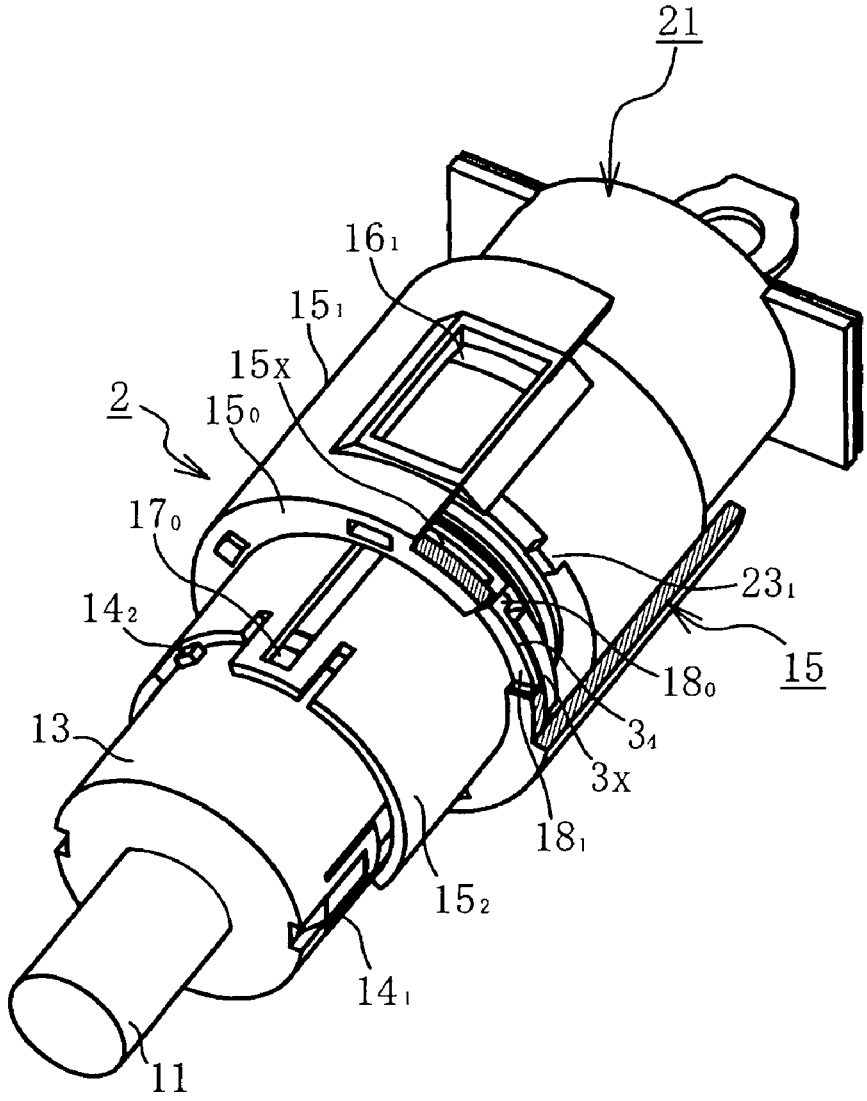
FIG. 6 is a perspective view illustrating the male and female connector parts being mated, with a part cut away.

In advance, the annular packing 20 is press-fitted onto the front portion 3, of the female housing 3, and the rotating ring 15 is mounted over the rear portion $3_2$. The order of such mounting is: first the large-diameter cylindrical part $15_1$, then the small-diameter cylindrical part $15_2$. The plural small protuberances inside the small-diameter cylindrical part $15_2$, which are not shown in the drawings, are formed in positions where they will pass between the protrusions $8_2$, $8_2$ in the housing 3, so that during the above-mentioned mounting, the small-diameter cylindrical part's small protuberances pass between the protrusions $8_2$, $8_2$ and there is no hindrance to the mounting. After being mounted onto the housing 3, the rotating ring 15 is rotated a little, whereupon the surface $15_X$ of the step difference wall $15_0$ of the rotating ring 15 contacts against the rear face $3_X$ of the flange $3_3$, and the small protuberances inside the small-diameter cylindrical portion $15_2$ latch onto the protrusions $8_2$, $8_2$ of the female housing 3, thereby fixing the rotating ring 15 to the housing 3. As a result of such fixing, the latching section $18_1$ provided on the step difference wall $15_0$ is pressed into contact with the flange $3_3$, and the latching tab $18_0$ are latched into the cut-out slots $3_4$, so that rotation of the rotating ring 15 is inhibited, as shown in FIG. 6.

Subsequently, the cover member 13, the annular packing 12 and the tubular seal member 10 are mounted onto the electric cable 11, then the cores $11_0$ of the electric cable 11 are clamp-connected to the cable connection portion $9_2$ of the contact pin 9. Next, the tubular seal member 10 is shifted forward, the electric cable's shielding 11*b* is clamp-connected by means of the clamping portion $10_2$, and the tubular seal member 10 is inserted into the gap 5 inside the attaching hole 4. As a result of such insertion, part of the tubular seal member 10 is exposed through the indentation portions 6*a*, 6*b* of the housing front portion $3_1$. After that, the annular packing 12 is inserted into the first attaching hole $4_1$, and the cover member 13 is mounted over the housing 3's rear portion $3_2$, with the latching portions $14_1$, $14_1$ being made to latch onto the small protuberances $8_1$, $8_1$. As a result, the cover member 13 is fixed to the rear portion $3_2$ of the housing 3.

The male connector part 21 will now be described with reference to FIGS. 1 and 5.

The male connector part 21 is composed of a flat-plate contact pin 24, a male housing 22 into which the contact pin 24 is fitted, and a pair of ground terminals 25*a* and 25*b*. The male housing 22 has an opening 22*a* into which the front portion $3_1$ of the female housing 3 is inserted. This opening

22*a* is of almost equal length to the front portion $\mathbf{3}_1$ of the female housing 3, takes the form of a round cylindrical body whose interior is closed off by a rear end wall 22*b*, and is formed of synthetic resin. As shown in FIG. 1, the outer periphery of the male housing 22 is divided into a front portion $\mathbf{22}_1$ and a rear portion $\mathbf{22}_2$, the front portion $\mathbf{22}_1$ being formed thicker than the rear portion $\mathbf{22}_2$. At the boundary between the front portion $\mathbf{22}_1$ and the rear portion $\mathbf{22}_2$ there is formed a step difference wall $\mathbf{22}_0$. In the thicker, front portion $\mathbf{22}_1$ there are formed first and second pairs of flat-bottomed thin grooves 23*a* and 23*a*, spaced particular distances apart and roughly parallel. The inner ends of the first pair of flat-bottomed thin grooves 23*a* are blocked off by blocking walls 23*a*', and during mating with the female connector part 2, the locking bars $\mathbf{16}_0$ will be guided into and engage with this first pair of thin grooves 23*a*. Further, in the step difference wall $\mathbf{22}_0$ there are formed indented portions $\mathbf{22}_0$' which are adjacent to the first thin grooves 23*a* and a part of which is cut out. The locking bars $\mathbf{16}_0$, guided by the first thin grooves 23*a*, will latch into these indented portions $\mathbf{22}_0$'. Moreover, the small protuberances $\mathbf{19}_1$ inside the rotating ring 15 will be guided into and engage with the second pair of flat-bottomed thin grooves 23*a*.

Also, at the front portion $\mathbf{22}_1$'s front end, that is, the surface that joins with the female connector part 2, there are formed plural protruding portions—for example two protrusions $\mathbf{23}_1$ and $\mathbf{23}_2$—at a spacing such as to correspond to the cut-out slots $\mathbf{3}_4$, $\mathbf{3}_4$ in the flange $\mathbf{3}_3$ of the female housing 3. Furthermore, in the rear end wall 22*b* there are formed a slit 22*c*, located a little below the center, for attachment of the contact pin 24, and curved slits 22*d* and 22*e*, located at either side, for attachment of the ground terminals 25*a* and 25*b*. The contact pin 24 has a flat-plate contacting portion 24*a* and a cable connecting portion 24*b*, not shown in the drawings, for clamp-connection to the electric cable, and is formed of a metal material with good conductivity. The pair of ground terminals 25*a* and 25*b* are for insertion into the indented portions 6*a* and 6*b* of the female housing 3, and are composed of contacting portions $\mathbf{25}_1$, $\mathbf{25}_1$ whose mutually opposed surfaces are curved into a circular form, and terminal portions $\mathbf{25}_0$, $\mathbf{25}_0$ that are connected to the electric cable.

Figure 7:
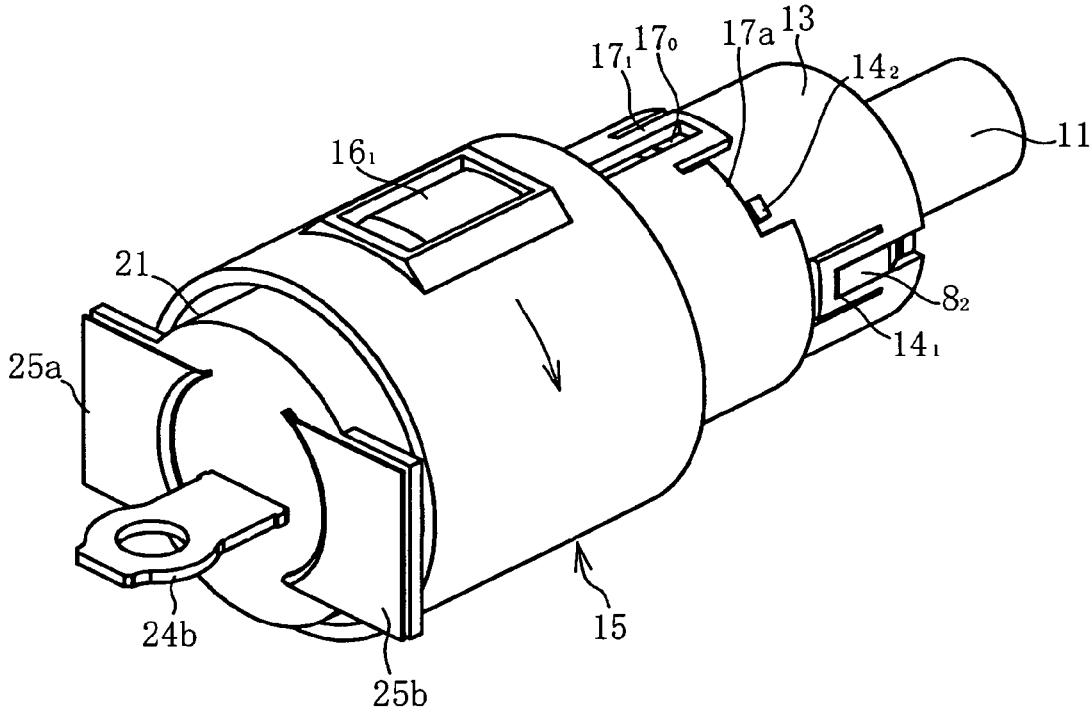
FIG. 7 is a perspective view illustrating the male and female connector parts being mated.
Figure 8:
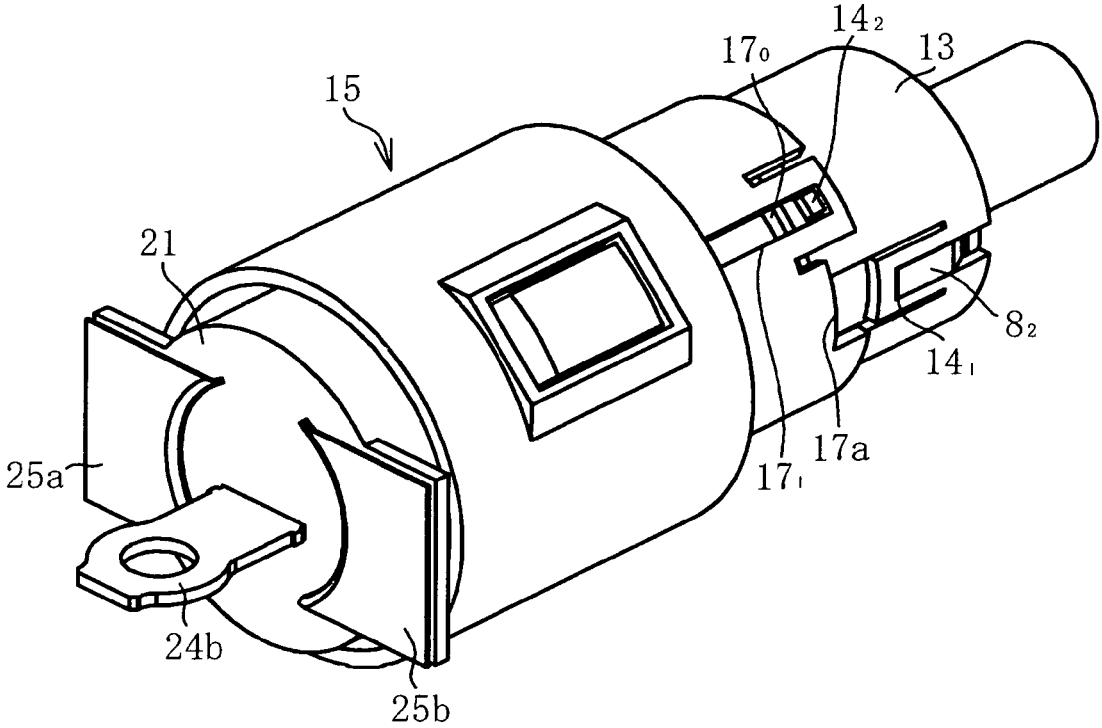
FIG. 8 is a perspective view illustrating the male and female connector parts in the mated state.
Figure 9:
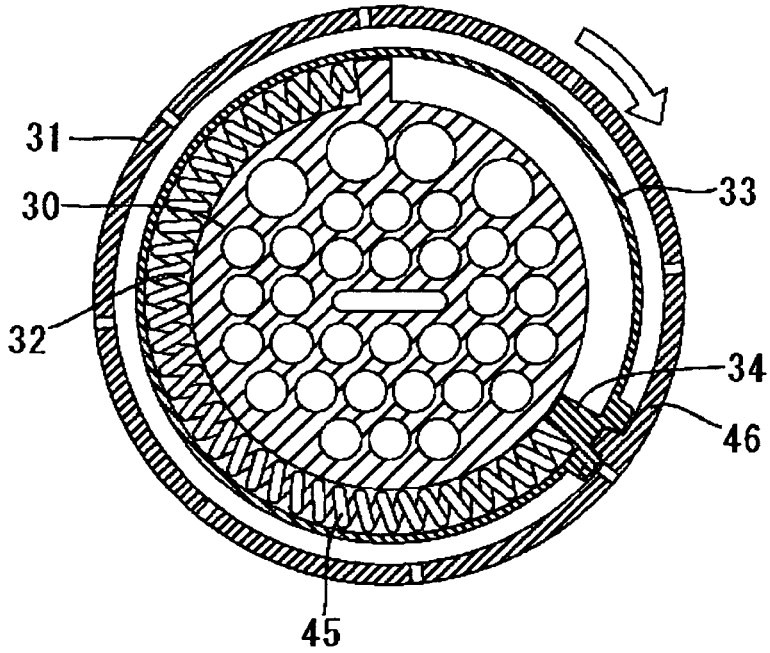
FIG. 9 is a transverse cross-sectional view of a related art connector in the locked state.
Figure 9:
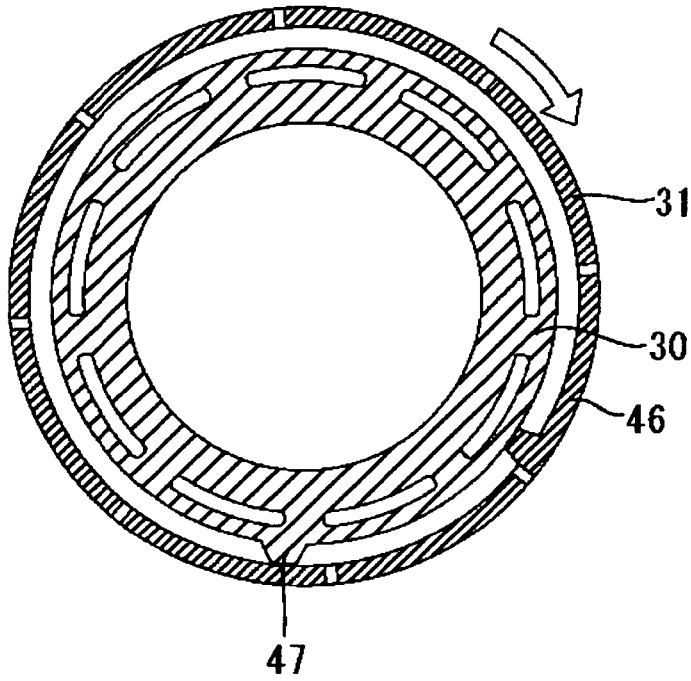

Next will be described the mating and coupling of the female connector part 2 and male connector part 21, with reference to FIGS. 1 to 8. FIG. 6 is a perspective view illustrating the male and female connector parts being mated, with a part cut away; FIG. 7 is a perspective view illustrating the male and female connector parts being mated; and FIG. 8 is a perspective view illustrating the male and female connector parts in the mated state.

In the assembled female connector part 2, the step difference wall $\mathbf{15}_0$ connecting to the large-diameter cylindrical portion $\mathbf{15}_1$ of the rotating ring 15 contacts against the rear face $\mathbf{3}_X$ of the flange $\mathbf{3}_3$ provided on the housing 3, and the small protuberances inside the small-diameter cylindrical portion $\mathbf{15}_2$, which are not shown in the drawings, are latched onto the protrusions $\mathbf{8}_2$, $\mathbf{8}_2$ in the housing 3, so that the rotating ring 15 is fixed to the housing 3. As a result of such fixing, the resilient latching sections $\mathbf{18}_1$ and $\mathbf{18}_1$ provided on the step difference wall $\mathbf{15}_0$ of the rotating ring are pressed against the face $\mathbf{3}_X$ of the flange $\mathbf{3}_3$ and also engage into the cut-out slots $\mathbf{3}_4$, $\mathbf{3}_4$ on the face $\mathbf{3}_X$, so that rotation of the rotating ring 15 is inhibited (see FIG. 6).

When, in this state, the female connector part 2 is plugged into the male connector part 21, the housing 22 of the male connector part 21 is inserted into the gap D of the female connector part 2, the contacting portion 24*a* of the contact pin 24 is fitted into the thin slot 4*a*, and the contacting portions $\mathbf{25}_1$, $\mathbf{25}_1$ of the ground terminals 25*a*, 25*b* contact with the tubular seal member 10 exposed through the indented portions 6*a*, 6*b* of the housing 3. Also, the locking bars $\mathbf{16}_0$, $\mathbf{16}_0$ of the pair of locking legs $\mathbf{16}_1$, $\mathbf{16}_1$ are guided and inserted into the first flat-bottomed thin grooves 23*a*, 23*a* of the male connector part 21, and the small protuberances $\mathbf{19}_1$, $\mathbf{19}_1$ inside the large diameter cylindrical portion 15, into the second flat-bottomed thin grooves 23*b*, 23*b*.

If such plugging of the female connector part 2 into the male connector part 21 results in the two parts 21 and 2 being completely mated and coupled, the protrusion $\mathbf{23}_1$, $\mathbf{23}_2$ at the front end of the male housing 22 strike against the latching tabs $\mathbf{18}_0$, $\mathbf{18}_0$, pushing the latching tabs $\mathbf{18}_0$, $\mathbf{18}_0$, out from the cut-out slots $\mathbf{3}_4$, $\mathbf{3}_4$ of the flange $\mathbf{3}_3$ and disengaging the latching tabs $\mathbf{18}_0$, $\mathbf{18}_0$ and the cut-out slots $\mathbf{3}_4$, $\mathbf{3}_4$, with the result that the rotating ring 15 is enabled to rotate. But if at such time the female and male connector parts 21 and 2 have not been completely mated and coupled, the latching tabs $\mathbf{18}_0$, $\mathbf{18}_0$ and cut-out slots $\mathbf{3}_4$, $\mathbf{3}_4$ will not be disengaged, and the rotating ring 15 will not be enabled to rotate. Therefore, the state of coupling of the male and female connector parts, or in other words, whether they are in a half-fitted state or have been mated correctly, can be sensed according to whether or not the rotating ring 15 is able to rotate.

When the rotating ring 15 is able to rotate and is rotated in the direction indicated by the arrow in FIG. 7, such rotation will result in the locking bars $\mathbf{16}_0$, $\mathbf{16}_0$, and the small protuberances $\mathbf{19}_1$, $\mathbf{19}_1$ moving beyond the blocking walls 23*a*' of the first flat-bottomed thin grooves 23*a*, 23*a*, being guided by the indented portions $\mathbf{22}_0$' and the thin slots 23*b*, 23*b* respectively, and being latched and locked into the step difference wall $\mathbf{22}_0$.

On the other hand, the latching portions $\mathbf{17}_1$, $\mathbf{17}_1$ of the rotating ring 15's small-diameter cylindrical portion $\mathbf{15}_2$ are, by virtue of their resilience, latched onto the small protrusions $\mathbf{14}_2$, $\mathbf{14}_2$, thereby preventing return. Once the foregoing latching is effected, the rotating ring 15 will not turn simply by being rotated, and therefore in order to make it turn, a tool or the like must be used to move away the latching portions $\mathbf{17}_1$, $\mathbf{17}_1$.

Since the rotating ring 15 covers the front portion $\mathbf{3}_1$ of the housing 3, the annular packing 20 fitted to the housing is protected. Also, since the rotating ring 15 covers the housing 3 over a particular extent, even if the housing 3 is inserted diagonally during coupling with the male connector part 21, path correction to the normal insertion direction will be effected, thus preventing poor contacting or breakage, etc., due to what is termed "forcing". Moreover, the fact that the rotating ring 15 has a function enabling sensing of a half-fitted state renders unnecessary springs or other parts such as are present in the related art, so that the number of components is reduced, enabling the structure to be rendered simple.

The present invention is not restricted to the foregoing embodiment. In that embodiment the male and female connector parts each had a single contact pin, but they could have plural contact pins, and the seal member could be omitted. Also, the rotating ring and the cover member were separate items, but alternatively they could be integrated. If they are integrated, the anti-rotation for the rotating ring will be formed between them and the female housing. Such integration will enable protection of the annular packing, formation of locking legs, as well as sensing functions and a function for preventing dislodgement of the packing that fixes the electric cable, to be provided via the rotating ring, thus permitting the number of components to be further reduced. Furthermore, the locking legs were provided on the rotating ring, but could alternatively be provided on the female connector part. Moreover, the locking legs and mating protuberances may be either single or plural items. Also, the foregoing embodiment represents a waterproof connector provided with annular packing or the like measure, but alternatively, where waterproofing is not required, the connector may be rendered non-waterproof by omitting the annular packing.

The invention claimed is:

1. A connector comprising:

a first connector part having a first housing fitted with a contact pin;

a second connector part having a second housing fitted with another contact pin that contacts and connects with said contact pin; and a rotating ring that is fitted to said first housing so as to be freely rotatable and that has a locking mechanism that locks the coupling of said first and second connector parts;

said rotating ring's rotation being inhibited by an anti-rotation mechanism provided between said rotating ring and said first housing, said rotating ring being latched into said first housing by said anti-rotation mechanism prior to the coupling of said first and second connector parts, and when said first and second connector parts are mated and coupled, the rotation inhibition for said rotating ring is terminated by the second connector part being pushed into the first connector part, so that said rotating ring is allowed to rotate, and the coupling of said first and second connector parts is locked via said locking mechanism.

2. The connector according to claim 1, wherein said anti-rotation mechanism is composed of a first latching portion provided on said rotating ring and a second latching portion provided on said first housing, at least one of the first and second latching portions is formed of an elastic material having resilience, and rotation of said rotating ring is prevented by said first and second latching portions mating with each other utilizing the resilience of the elastic material.

3. The connector according to claim 1, further comprising an anti-return mechanism that inhibits return rotation of said rotating ring, the anti-return mechanism being between the rotating ring and a cover member provided so as to cover the rear-end portion of said first housing.

4. The connector according to claim 3, wherein said anti-return mechanism is provided between said rotating ring and said first housing.

5. The connector according to claim 3, wherein said anti-return mechanism is composed of a third latching portion provided on said rotating ring and a fourth latching portion provided on said cover member, at least one of said third and fourth latching portions is formed of an elastic material having resilience, and said third and fourth latching portions are mated with each other utilizing the resilience of said elastic material.

6. The connector according to claim 1, wherein said rotating ring is formed of a round cylindrical body of a particular length and is so fitted as to cover the outer periphery of said first housing.

7. The connector according to claim 1, wherein said first housing is fitted with tubular seal material formed of metal material, and said second housing is fitted with a grounding member, and when said first and second connector parts are mated and coupled, said tubular seal material and said grounding members are ground-connected to each other.

8. The connector according to claim 1, wherein said first and second housings are formed as a female and a male housing that are mated and coupled to each other.

* * * * *